United States Patent [19]

Gassen

[11] Patent Number: 4,926,637

[45] Date of Patent: May 22, 1990

[54] EXHAUST CONFIGURATION

[75] Inventor: James Gassen, Charlotte, N.C.

[73] Assignee: Textron Inc., Providence, R.I.

[21] Appl. No.: 245,569

[22] Filed: Sep. 19, 1988

[51] Int. Cl.[5] ..... F01N 3/02

[52] U.S. Cl. ..... 60/317

[58] Field of Search ..... 60/316, 317, 319, 307

[56] References Cited

U.S. PATENT DOCUMENTS

| | | | |
|---|---|---|---|
| 2,112,534 | 3/1938 | Keen | 60/316 |
| 3,862,540 | 1/1975 | Harvey | 60/307 |
| 4,809,502 | 3/1989 | Iida | 60/316 |

FOREIGN PATENT DOCUMENTS

| | | | |
|---|---|---|---|
| 198929 | 6/1923 | United Kingdom | 60/319 |

*Primary Examiner*—Douglas Hart

*Attorney, Agent, or Firm*—Abraham Ogman

[57] ABSTRACT

An exhaust configuration for a gasoline engine where the exhaust gas is merged with an air stream in a direction counter to the direction of flow of the air stream for reducing noise and for supercharging the engine and for reducing the amount of oil that may become entrained in the exhaust stream.

10 Claims, 2 Drawing Sheets

EXHAUST CONFIGURATION

BACKGROUND

The invention relates to a novel exhaust configuration specifically designed to reduce the noise level associated with operating a gasoline engine powered apparatus such as a blower or blower-vacuum apparatus ,improve operating efficiency and aid in the combustion of oil or unburned fuel that may be entrained within an exhaust stream.

In either of the aforementioned apparatus air is drawn into an air intake associated with a centrifugal fan. The air stream is then coupled to a volute shaped duct and exits the apparatus as a jet via a volute opening.

In the vacuum mode leaves and other debris is drawn in the air intake and traverses the volute duct and is collected in a bag attached to the volute opening. There is inherently a disturbing noise level associated with gas engine powered units through these come equipped with mufflers. The noise level generally increases with the horsepower. Blower-vacuum apparatus are often used over long periods of time. The noise is such that after a time the operator experiences discomfort and becomes fatigued. Often operators are advised to wear protective ear gear to prevent damage to the ears.

Most portable gas engines use a two cycle engine where lubricating oil is mixed directly with the gas and burned in the cylinder. Lubricating oil or unburned fuel which is not consumed within the cylinder generally clings to the walls of the muffler or exhaust pipe where it is usually burned. To the extent that unconsumed oil and fuel remains in the exhaust stream it is atomized within the exhaust stream. To the extent that this happens it can be messy. Oil can coat the apparatus, or surrounding surfaces with which the exhaust stream comes into contact.

The invention deals with a concept of coupling and merging the exhaust gases leaving the muffler of a gasoline engine with the air stream generated within the blower or the blower-vacuum apparatus for the purpose of reducing the noise level of apparatus and for improving the overall efficiency of the gas engine and for increasing or completing the combustion of oil within the engine.

The U.S. Pat. No. 1,331,649 to Kettering and the French patent No. 1,008,190 shows the mixing of exhaust gases in an air stream in an automobile environment. Specifically, these patents show the exhaust stream and air stream flowing in the same direction.

The U.S. Pat. No. 2,927,422 to Shaffer depicts an exhaust stream flowing in an air stream in a direction opposite to the air stream. In this case the exhaust stream is unconfined and distributed over a relatively large area and discharged against a relatively cool radiator core to extinguish sparks that may exist in the exhaust stream.

OBJECTS

It is an object of the invention to provide a gas powered portable apparatus with an exhaust system configuration which avoids the limitations and disadvantages of prior configurations.

It is another object of the invention to provide an exhaust configuration for a blower or a blower-vacuum apparatus which reduces noise levels from engine exhausts.

It is another object of the invention to provide a blower or a blower-vacuum apparatus where the exhaust is coupled into the air stream where it merges with the air stream in a way that builds up the back pressure within the exhaust system.

It is yet another object of the invention to provide an exhaust system which tends to maintain oil and fuel entrained in the exhaust stream within the exhaust system for a longer period of time thereby enabling more complete combustion of the entrained oil and fuel.

SUMMARY OF THE INVENTION

In accordance with the invention there is provided a gas powered apparatus and more particularly a portable apparatus such as a a blower or a blower-vacuum apparatus in which the muffler exhaust stream of the apparatus is merged with the air stream generated within the apparatus. The exhaust stream is made to flow counter or opposite to the direction of the air stream. Preferably the exhaust stream is coupled into the volute duct adjacent to the volute opening of the blower-vaccum.

BRIEF DESCRIPTION OF THE FIGURES

The novel features that are considered characteristic of the invention itself, however, both as to its organization and method of operation, together with additional objects and advantages thereof , will best be understood from the following description of a specific embodiment , when read in conjunction with the accompanying drawings, in which.

DESCRIPTION OF THE INVENTION

Figure 1:
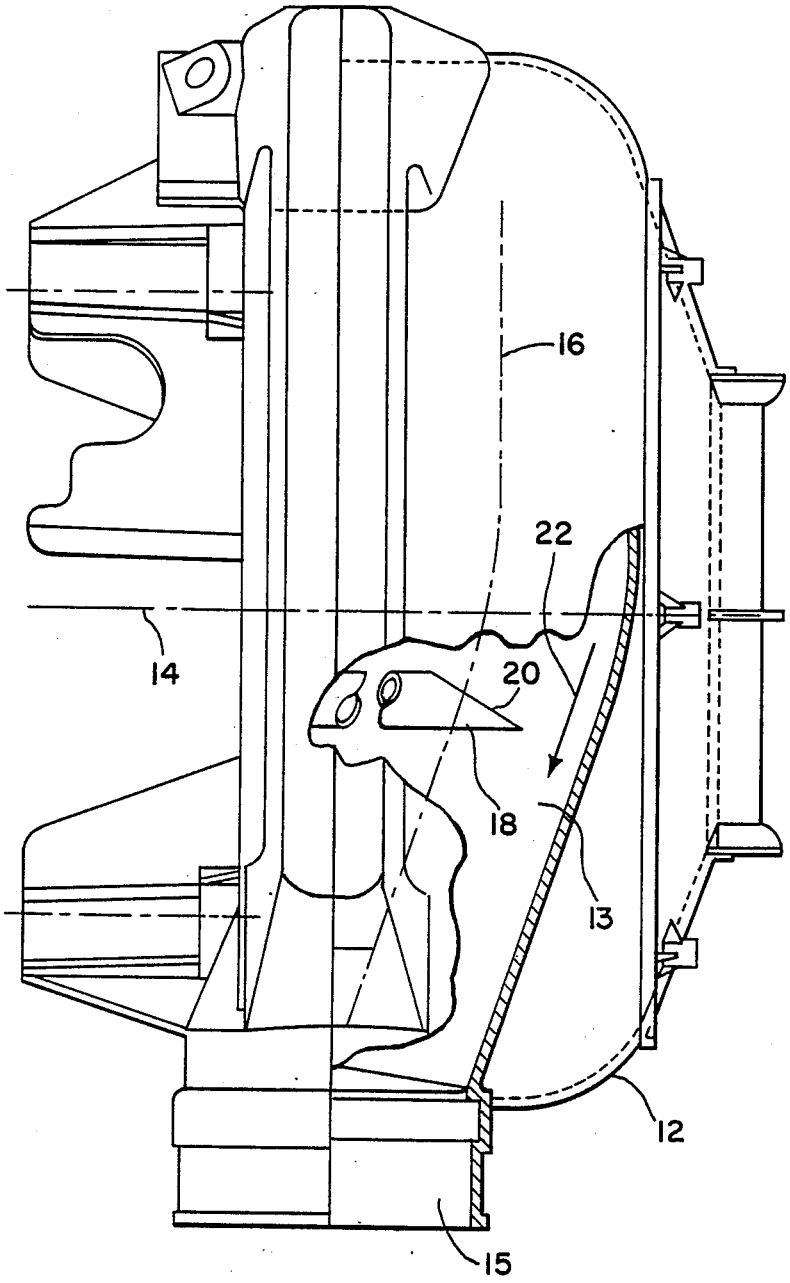
FIG. 1 is a top side view of a centrifugal blower-vacuum apparatus where the position of the exhause pipe positioned in the volute duct is exposed.

Referring to FIG. 1 there is shown a centrifugal blowervacuum apparatus 10 having a volute housing 12 containing a volute duct 13 and a volute opening 15. The gas engine is not shown in this figure though the axis of the drive shaft is illustrated at 14. The symbol 16 identifies the axis of the volute duct 13 and of the volute opening 15. An exhaust pipe 8 is shown projecting into the volute duct 13 adjacent to the volute opening 15. An exit opening 20 is at the terminal end of the exhaust pipe 18. The surface of the opening 20 is angled relative to the direction of air flow so that a portion of the air flowing within the volute duct 13 tends to flow into the opening 20. The direction of the air stream within the volute duct 13 is illustrated by the arrow 22.

Figure 2:
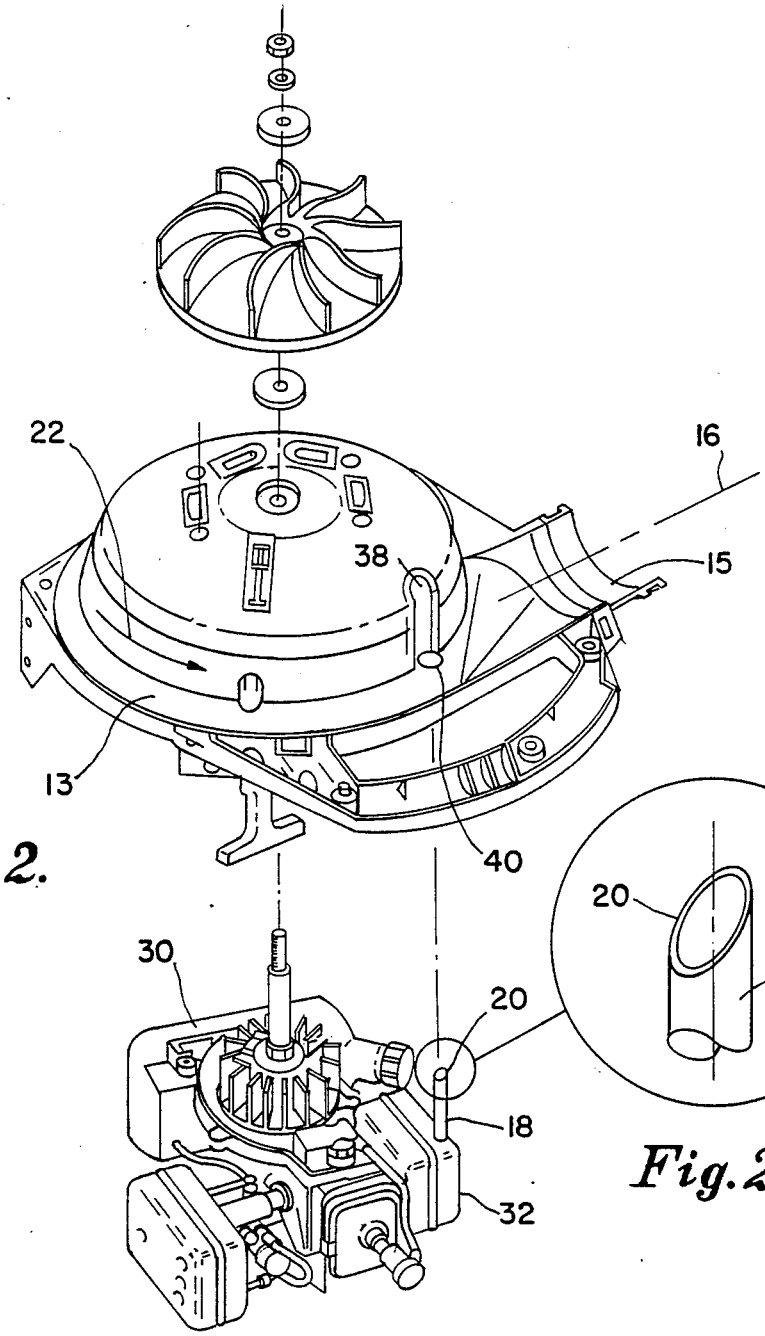
FIG. 2 is an exploded view of the FIG. 1 apparatus showing the relative location of the exhaust muffler, the exhaust pipe the volute duct, and the volute opening.
Figure 2A:
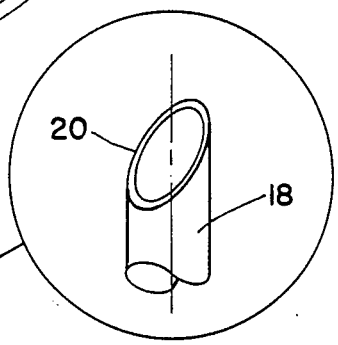

Referring to FIG. 2 there is shown an exploded view of a blower or blower vacuum apparatus with part of the volute housing missing. A gasoline engine 30 is shown along with its muffler 32 and exhaust pipe 18 through which the exhaust stream exits the engine 30. The exhaust pipe 18 passes through an opening 40 in the wall of the volute housing 12 so that the opening 20 of the exhaust pipe 18 is positioned within the volute duct 13. The opening 20 is oriented to cause the exhaust gas to flow counter , or opposite , to the direction of air flow in the volute duct 13 shown by the arrow 22. The counterflow also creates some turbulence in the vicinity of the opening 20 which tends to quickly dissipate the exhaust gases exiting the opening.

In this case the exhaust pipe 18 is situated within a channel 38 to accommodate an existing engine to an existing housing; i.e. packaging. Ideally the exhaust pipe 18 will be centered in the volute duct 13. Means for sealing the opening 40 through which the exhaust pipe 18 is inserted into the volute housing 12 is not shown.

In the applications described the mixing of exhaust gases and air takes place in a duct, a relatively confined region. The onrushing air is thus directed against the inclined opening 20 thereby building up the back pressure within the exhaust system. The buildup of back pressure in this environment actually forces the exhaust gas to exit the exhaust pipe 18 in a direction opposite to the direction of flow of the air.

There are manifold effects from mixing the exhaust gases directly with the air leaving the apparatus in the volute duct. First, there is a very significant reduction in the noise level emanating from the apparatus. Additional reduction in the overall noise level over prior such devices is achieved by the counterflow of exhaust and air. A significant reduction in line of sight noise in particular was noted when the direction of flow of the exhaust gas was directed counter to the direction of air flow.

An increase in engine efficiency was also noted because of the unique direction of the exhaust pipe opening 20. The air rushing against the opening 20 built up a back pressure in the muffler. In a small but nevertheless significant way the air flowing opposite to the direction of the exhaust acts like a supercharger.

Yet a third benefit noted was that there was a very significant reduction in the amount of entrained oil leaving the apparatus in the air stream when in fact oil tended to be entrained in the exhaust stream. It seems that the onrushing air pushes such oil back into the exhaust system where it remains for a longer period of time and is combusted.

It is possible to use a simpler and less costly muffler because baffles , diffusers and resonators can be eliminated.

The various features and advantages of the invention are thought to be clear from the foregoing description. Various other features and advantages not specifically enumerated will undoubtedly occur to those versed in the art, as will many variations and modifications of the preferred embodiment illustrated, all of which may be achieved without departing from the spirit and scope of the invention as defined by the claims.

What is claimed is:

1. An exhaust configuration for a blower having a volute housing including a volute duct and a volute opening through which air exits the apparatus and a gas engine having an exhaust system through which an exhaust stream leaves the engine comprising: means for coupling and merging the exhaust stream with the air stream within the volute duct so that the air stream flows into the exhaust stream for increasing the back pressure of the exhaust stream.

2. An exhaust configuration for a blower apparatus having a volute housing including a volute duct and a volute opening through which air exits the apparatus and a gas engine having an exhaust system including an exhaust pipe having an opening through which an exhaust stream leaves the engine comprising:

the opening of the exhaust pipe being positioned in the volute duct of the volute housing so that the exhaust stream leaving the exhaust pipe flows opposite to the direction of flow of the air stream for merging the exhaust stream with the air stream.

3. An exhaust configuration as defined in claim 2 where said opening is positioned in the volute duct adjacent to the volute opening.

4. An exhaust configuration as defined in claim 2 where said opening is defined at the terminal end of the exhaust pipe and comprises a surface which is angularly inclined relative to the direction of air flow.

5. An exhaust configuration for a blower apparatus having a volute housing including a volute duct and a volute opening through which air exits the apparatus and a gas engine having an exhaust system including an exhaust pipe having an opening through which an exhaust stream leaves the engine comprising:

the opening of the exhaust pipe being positioned in the volute housing so that the exhaust stream leaving the exhaust pipe flows opposite to the direction of flow of the air stream for merging the exhaust stream with the air stream.

6. An exhaust configuration for a blower-vacuum apparatus having a volute housing including a volute duct and a volute opening through which air exists the apparatus and a gas engine having an exhaust system through which an exhaust stream leaves the engine comprising:

means for coupling and merging the exhaust stream with the air stream within the volute duct so that the air steam flows into the exhaust steam for increasing the back pressure of the exhaust stream.

7. An exhaust configuration for a blower - vacuum apparatus having a volute housing including a volute duct and a volute opening through which air exits the apparatus and a gas engine having an exhaust system including an exhaust pipe having an opening through which an exhaust stream leaves the engine comprising:

the opening of the exhaust pipe being positioned in the volute duct of the volute housing so that the exhaust stream leaving the exhaust pipe flows opposite to the direction of flow of the air stream for merging the exhaust stream with the air stream.

8. An exhaust configuration as defined in claim 7 where said opening is positioned in the volute duct adjacent to the volute opening.

9. An exhaust configuration as defined in claim 7 where the said opening is defined at the terminal end of the exhaust pipe and comprises a surface which is angularly inclined relative to the direction of air flow.

10. An exhaust configuration for a blower-vacuum apparatus having a volute housing including a volute duct and a volute opening through which air exits the apparatus and a gas engine having an exhaust system including an exhaust pipe having an opening through which an exhaust stream leaves the engine comprising:

the opening of the exhaust pipe being positioned in the volute housing so that the exhaust stream leaving the exhaust pipe flows opposite to the direction of flow of the air stream for merging the exhaust stream with the air stream.

* * * * *